US008494190B2

(12) United States Patent
Sakai

(10) Patent No.: US 8,494,190 B2
(45) Date of Patent: Jul. 23, 2013

(54) AUDIO SIGNAL PROCESSING APPARATUS AND AUDIO SIGNAL PROCESSING METHOD

(75) Inventor: Kazuki Sakai, Tokyo (JP)

(73) Assignee: Sony Corporation, Tokyo (JP)

( * ) Notice: Subject to any disclaimer, the term of this patent is extended or adjusted under 35 U.S.C. 154(b) by 256 days.

(21) Appl. No.: 13/111,559

(22) Filed: May 19, 2011

(65) Prior Publication Data

US 2011/0299706 A1 Dec. 8, 2011

(30) Foreign Application Priority Data

Jun. 7, 2010 (JP) ..... P2010-130316

(51) Int. Cl.
*H04R 5/02* (2006.01)

(52) U.S. Cl.
USPC ..... 381/303; 381/300; 381/304; 381/305; 381/58; 381/59

(58) Field of Classification Search
USPC ..... 381/303, 56, 58, 59, 96, 97, 98, 300, 381/304, 305; 700/94
See application file for complete search history.

(56) References Cited

FOREIGN PATENT DOCUMENTS

| | | |
|---|---|---|
| JP | 2006-101248 | 4/2006 |
| JP | 2006-319823 | 11/2006 |
| JP | 2006319823 A * | 11/2006 |

* cited by examiner

*Primary Examiner* — Vivian Chin
*Assistant Examiner* — Paul Kim
(74) *Attorney, Agent, or Firm* — Finnegan, Henderson, Farabow, Garrett & Dunner, L.L.P.

(57) ABSTRACT

An audio signal processing apparatus includes: a test signal supply unit to supply a test signal to each speaker of a multi-channel speaker including a center speaker and others; a speaker angle calculation unit to calculate an installation angle of each speaker with an orientation of a microphone as a reference, based on test audio output from each speaker and collected by the microphone; a speaker angle determination unit to determine an installation angle of each speaker with a direction of the center speaker from the microphone as a reference, based on the installation angle of the center speaker and the installation angles of the other speakers with the orientation of the microphone as a reference; and a signal processing unit to perform correction processing on an audio signal based on the installation angles of the speakers with the direction of the center speaker from the microphone as a reference.

5 Claims, 10 Drawing Sheets

AUDIO SIGNAL PROCESSING APPARATUS AND AUDIO SIGNAL PROCESSING METHOD

BACKGROUND

The present disclosure relates to an audio signal processing apparatus and an audio signal processing method that perform correction processing on an audio signal in accordance with the arrangement of a multi-channel speaker.

In recent years, an audio system in which audio content is reproduced by multi-channels such as 5.1 channels has been prevailing. In such a system, it is assumed that speakers are arranged at predetermined positions with a listening position where a user listens to audio as a reference. For example, as the standard on the arrangement of speakers in a multi-channel audio system, "ITU-R BS775-1 (ITU: International Telecommunication Union)" or the like has been formulated. This standard provides that speakers should be arranged at an equal distance from a listening position and at a defined installation angle. Further, a content creator creates audio content on the assumption that speakers are arranged in conformity with the standard as described above. Accordingly, it is possible to produce original acoustic effects by properly arranging speakers.

However, in private households or the like, a user may have a difficulty in correctly arranging speakers at defined positions as provided in the standard described above due to restrictions such as the shape of a room and the arrangement of furniture or the like. Preparing for such a case, an audio system in which correction processing is performed on an audio signal in accordance with positions of arranged speakers has been realized. For example, Japanese Patent Application Laid-open No. 2006-101248 (paragraph [0020], FIG. 1; hereinafter, referred to as Patent Document 1) discloses "a sound field compensation device" that enables a user to input an actual position of a speaker with use of a GUI (Graphical User Interface). This device performs, when reproducing audio, delay processing, assignment of audio signals to adjacent speakers in accordance with the input position of the speaker, or the like and performs correction processing on the audio signals as if the speakers are arranged at proper positions.

In addition, Japanese Patent Application Laid-open No. 2006-319823 (paragraph [0111], FIG. 1; hereinafter, referred to as Patent Document 2) discloses "an acoustic device, a sound adjustment method and a sound adjustment program" that collect audio of a test signal with use of a microphone arranged at a listening position to calculate a distance and an installation angle of each speaker with respect to the microphone. This device performs, when reproducing audio, adjustment or the like of a gain or delay in accordance with the calculated distance and installation angle of each speaker with respect to the microphone and performs correction processing on audio signals as if the speakers are arranged at proper positions.

SUMMARY

Here, the device disclosed in Patent Document 1 disables correction processing properly on an audio signal in a case where a user does not input a correct position of a speaker. Further, the device disclosed in Patent Document 2 sets an orientation of the microphone as a reference for the installation angle of the speaker, so it is necessary for the orientation of the microphone to coincide with a front direction, that is, a direction in which a screen or the like is arranged, in order to properly perform correction processing on an audio signal. In private households or the like, however, it is difficult for a user to cause the orientation of a microphone to correctly coincide with a front direction.

In view of the circumstances as described above, it is desirable to provide an audio signal processing apparatus capable of performing proper correction processing on an audio signal in accordance with an actual position of a speaker.

According to an embodiment of the present disclosure, there is provided an audio signal processing apparatus including a test signal supply unit, a speaker angle calculation unit, a speaker angle determination unit, and a signal processing unit.

The test signal supply unit is configured to supply a test signal to each of speakers of a multi-channel speaker including a center speaker and other speakers.

The speaker angle calculation unit is configured to calculate an installation angle of each of the speakers of the multi-channel speaker with an orientation of a microphone as a reference, based on test audio output from each of the speakers of the multi-channel speaker by the test signals and collected by the microphone arranged at a listening position.

The speaker angle determination unit is configured to determine an installation angle of each of the speakers of the multi-channel speaker with a direction of the center speaker from the microphone as a reference, based on the installation angle of the center speaker with the orientation of the microphone as a reference and the installation angles of the other speakers with the orientation of the microphone as a reference.

The signal processing unit is configured to perform correction processing on an audio signal based on the installation angles of the speakers of the multi-channel speaker with the direction of the center speaker from the microphone as a reference, the installation angles being determined by the speaker angle determination unit.

The installation angle of each speaker of the multi-channel speaker, which is calculated by the speaker angle calculation unit from the test audio collected by the microphone, has the orientation of the microphone as a reference. On the other hand, an installation angle of an ideal multi-channel speaker defined by the standard has a direction of a center speaker from a listening position (position of microphone) as a reference. Therefore, in the case where the orientation of the microphone is deviated from the direction of the center speaker of the multi-channel speaker, even when the orientation of the microphone is set as a reference, proper correction processing corresponding to an installation angle of an ideal multi-channel speaker is difficult to be performed on an audio signal. Here, in the embodiment of the present disclosure, based on the installation angle of the center speaker with the orientation of the microphone as a reference and the installation angles of the other speakers with the orientation of the microphone as a reference, the installation angles of the speakers of the multi-channel speaker with the direction of the center speaker from the microphone as a reference are determined. Accordingly, even when the orientation of the microphone is deviated from the direction of the center speaker, it is possible to perform proper correction processing on an audio signal with the same reference as that for the installation angle of the ideal multi-channel speaker.

The signal processing unit may distribute the audio signal supplied to one of the speakers of the multi-channel speaker to speakers adjacent to the speaker such that a sound image is localized at a specific installation angle with the direction of the center speaker from the microphone as a reference.

When the installation angle of the speaker to which a specific channel is assigned is deviated from an ideal installation angle, an audio signal of the specific channel is distributed to that speaker and speakers adjacent thereto with an ideal installation angle therebetween. In this case, both an actual installation angle of the speaker and an ideal installation angle of the speaker have the direction of the center speaker from the microphone as a reference, so it is possible to localize a sound image of this channel at an ideal installation angle.

The signal processing unit may delay the audio signal such that a reaching time of the test audio to the microphone becomes equal between the speakers of the multi-channel speaker.

In the case where the distances between the speakers of the multi-channel speaker and the microphone (listening position) are not equal to each other, a reaching time of audio output from each speaker to the microphone differs. In the embodiment of the present disclosure, in this case, in conformity with a speaker having the longest reaching time, that is, the longest distance, the audio signals of the other speakers are delayed. Accordingly, it is possible to make correction as if the distances between the speakers of the multi-channel speaker and the microphone are equal.

The signal processing unit may perform filter processing on the audio signal such that a frequency characteristic of the test audio becomes equal between the speakers of the multi-channel speaker.

Depending on the structure of each speaker of the multi-channel speaker or a reproduction environment, the frequency characteristics of the audio output from the speakers are different. In the embodiment of the present disclosure, by performing the filter processing on the audio signal, it is possible to make correction as if the frequency characteristics of the speakers of the multi-channel speaker are uniform.

According to another embodiment of the present disclosure, there is provided an audio signal processing method including supplying a test signal to each of speakers of a multi-channel speaker including a center speaker and other speakers.

An installation angle of each of the speakers of the multi-channel speaker with an orientation of a microphone as a reference is calculated based on test audio output from each of the speakers of the multi-channel speaker by the test signals and collected by the microphone arranged at a listening position.

An installation angle of each of the speakers of the multi-channel speaker with a direction of the center speaker from the microphone as a reference is determined based on the installation angle of the center speaker with the orientation of the microphone as a reference and the installation angles of the other speakers with the orientation of the microphone as a reference.

Correction processing is performed on an audio signal based on the installation angles of the speakers of the multi-channel speaker with the direction of the center speaker from the microphone as a reference, the installation angles being determined by a speaker angle determination unit.

According to the embodiments of the present disclosure, it is possible to provide an audio signal processing apparatus capable of performing proper correction processing on an audio signal in accordance with an actual position of a speaker.

These and other objects, features and advantages of the present disclosure will become more apparent in light of the following detailed description of best mode embodiments thereof, as illustrated in the accompanying drawings.

DETAILED DESCRIPTION OF EMBODIMENTS

[Structure of Audio Signal Processing Apparatus]

Hereinafter, an embodiment of the present disclosure will be described with reference to the drawings.

Figure 1:
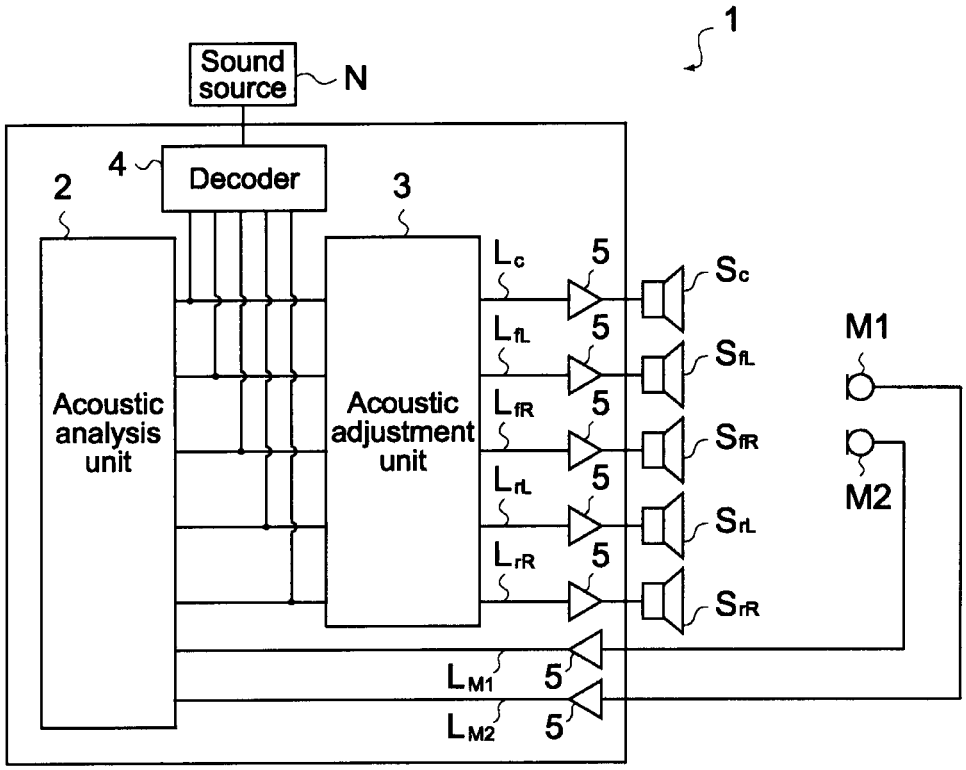
FIG. 1 is a diagram showing a schematic structure of an audio signal processing apparatus according to an embodiment of the present disclosure.

FIG. 1 is a diagram showing a schematic structure of an audio signal processing apparatus 1 according to an embodiment of the present disclosure. As shown in FIG. 1, the audio signal processing apparatus 1 includes an acoustic analysis unit 2, an acoustic adjustment unit 3, a decoder 4, and an amplifier 5. Further, a multi-channel speaker is connected to the audio signal processing apparatus 1. The multi-channel speaker is constituted of five speakers of a center speaker $S_c$, a front left speaker $S_{fL}$, a front right speaker $S_{fR}$, a rear left speaker $S_{rL}$, and a rear right speaker $S_{rR}$. Further, a microphone constituted of a first microphone M1 and a second microphone M2 is connected to the audio signal processing apparatus 1. The decoder 4 is connected with a sound source N including media such as a CD (Compact Disc) and a DVD (Digital Versatile Disc) and a player thereof.

The audio signal processing apparatus 1 is provided with speaker signal lines $L_c$, $L_{fL}$, $L_{fR}$, $L_{rL}$, and $L_{rR}$ respectively corresponding to the speakers, and microphone signal lines $L_{M1}$ and $L_{M2}$ respectively corresponding to the microphones. The speaker signal lines $L_c$, $L_{fL}$, $L_{fR}$, $L_{rL}$, and $L_{rR}$ are signal lines for audio signals, and connected to the speakers from the acoustic analysis unit 2 via the acoustic adjustment unit 3 and the amplifiers 5 provided to the signal lines. Further, the speaker signal lines $L_c$, $L_{fL}$, $L_{fR}$, $L_{rL}$, and $L_{rR}$ are each connected to the decoder 4, and audio signals of respective channels that are generated by the decoder 4 after being supplied from the sound source N are supplied thereto. The microphone signal lines $L_{M1}$ and $L_{M2}$ are also signal lines for audio signals, and connected to the microphones from the acoustic analysis unit 2 via the amplifiers 5 provided to the respective signal lines.

The audio signal processing apparatus 1 has two operations phases of an "analysis phase" and a "reproduction phase", details of which will be described later. In the analysis phase, the acoustic analysis unit 2 mainly operates, and in the reproduction phase, the acoustic adjustment unit 3 mainly operates. Hereinafter, the structure of the audio signal processing apparatus 1 in the analysis phase and the reproduction phase will be described.

Figure 2:
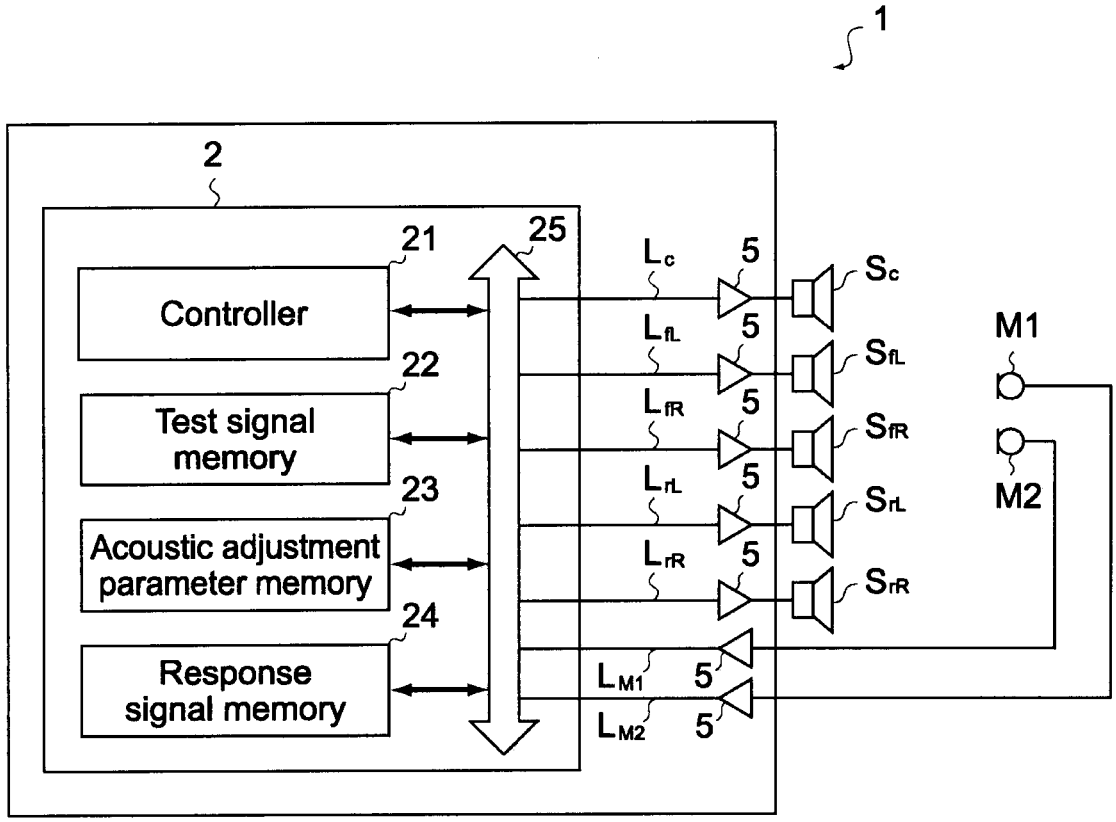
FIG. 2 is a block diagram showing a schematic structure of the audio signal processing apparatus in an analysis phase according to the embodiment of the present disclosure.

FIG. 2 is a block diagram showing a structure of the audio signal processing apparatus 1 in the analysis phase. In FIG. 2, the illustration of the acoustic adjustment unit 3, the decoder 4, and the like is omitted. As shown in FIG. 2, the acoustic analysis unit 2 includes a controller 21, a test signal memory 22, an acoustic adjustment parameter memory 23, and a response signal memory 24, which are connected to an internal data bus 25. To the internal data bus 25, the speaker signal lines $L_c$, $L_{fL}$, $L_{fR}$, $L_{rL}$, and $L_{rR}$ are connected.

The controller 21 is an arithmetic processing unit such as a microprocessor and exchanges signals with the following memories via the internal data bus 25. The test signal memory 22 is a memory for storing a "test signal" to be described later, the acoustic adjustment parameter memory 23 is a memory for storing an "acoustic adjustment parameter", and the response signal memory 24 is a memory for storing a "response signal". It should be noted that the acoustic adjustment parameter and the response signal are generated in the analysis phase to be described later and are not stored in the beginning. Those memories may be an identical RAM (Random Access Memory) or the like.

Figure 3:
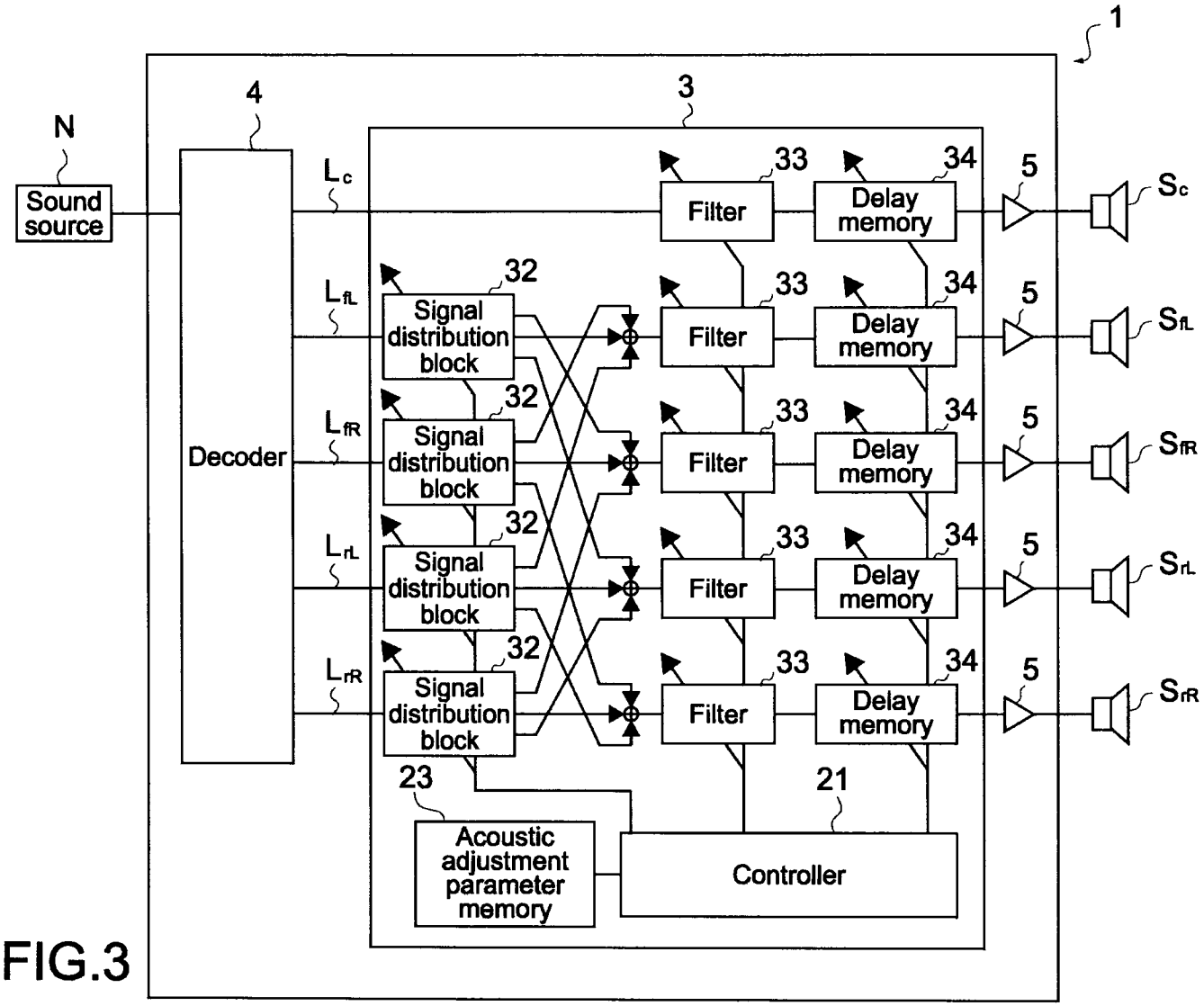
FIG. 3 is a block diagram showing a schematic structure of the audio signal processing apparatus in a reproduction phase according to the embodiment of the present disclosure.

FIG. 3 is a block diagram showing a structure of the audio signal processing apparatus 1 in the reproduction phase. In FIG. 3, the illustration of the acoustic analysis unit 2, the microphone, and the like is omitted. As shown in FIG. 3, the acoustic adjustment unit 3 includes a controller 21, an acoustic adjustment parameter memory 23, signal distribution blocks 32, filters 33, and delay memories 34.

The signal distribution blocks 32 are arranged one by one on the speaker signal lines $L_{fL}$, $L_{fR}$, $L_{rL}$, and $L_{rR}$ of the speakers except the center speaker $S_c$. Further, the filters 33 and the delay memories 34 are arranged one by one on the speaker signal lines $L_c$, $L_{fL}$, $L_{fR}$, $L_{rL}$, and $L_{rR}$ of the speakers including the center speaker $S_c$. Each signal distribution block 32, filter 33, and delay memory 34 are connected to the controller 21.

The controller 21 is connected to the signal distribution blocks 32, the filters 33, and the delay memories 34 and controls the signal distribution blocks 32, the filters 33, and the delay memories 34 based on an acoustic adjustment parameter stored in the acoustic adjustment parameter memory 23.

Each of the signal distribution blocks 32 distributes, under the control of the controller 21, an audio signal of each signal line to the signal lines of adjacent speakers (excluding center speaker $S_c$). Specifically, the signal distribution block 32 of the speaker signal line $L_{fL}$ distributes a signal to the speaker signal lines $L_{fR}$ and $L_{rL}$, and the signal distribution block 32 of the speaker signal line $L_{fR}$ to the speaker signal lines $L_{fL}$ and $L_{Rr}$. Further, the signal distribution block 32 of the speaker signal line $L_{rL}$ distributes a signal to the speaker signal lines $L_{fL}$ and $L_{rR}$, and the signal distribution block 32 of the speaker signal line $L_{rR}$ to the speaker signal lines $L_{fR}$ and $L_{rL}$.

The filters 33 are digital filters such as an FIR (Finite impulse response) filter and an IIR (Infinite impulse response) filter, and perform digital filter processing on an audio signal. The delay memories 34 are memories for outputting an input audio signal with a predetermined time of delay. The functions of the signal distribution blocks 32, the filters 33, and the delay memories 34 will be described later in detail.

[Arrangement of Multi-Channel Speaker]

Figure 4:
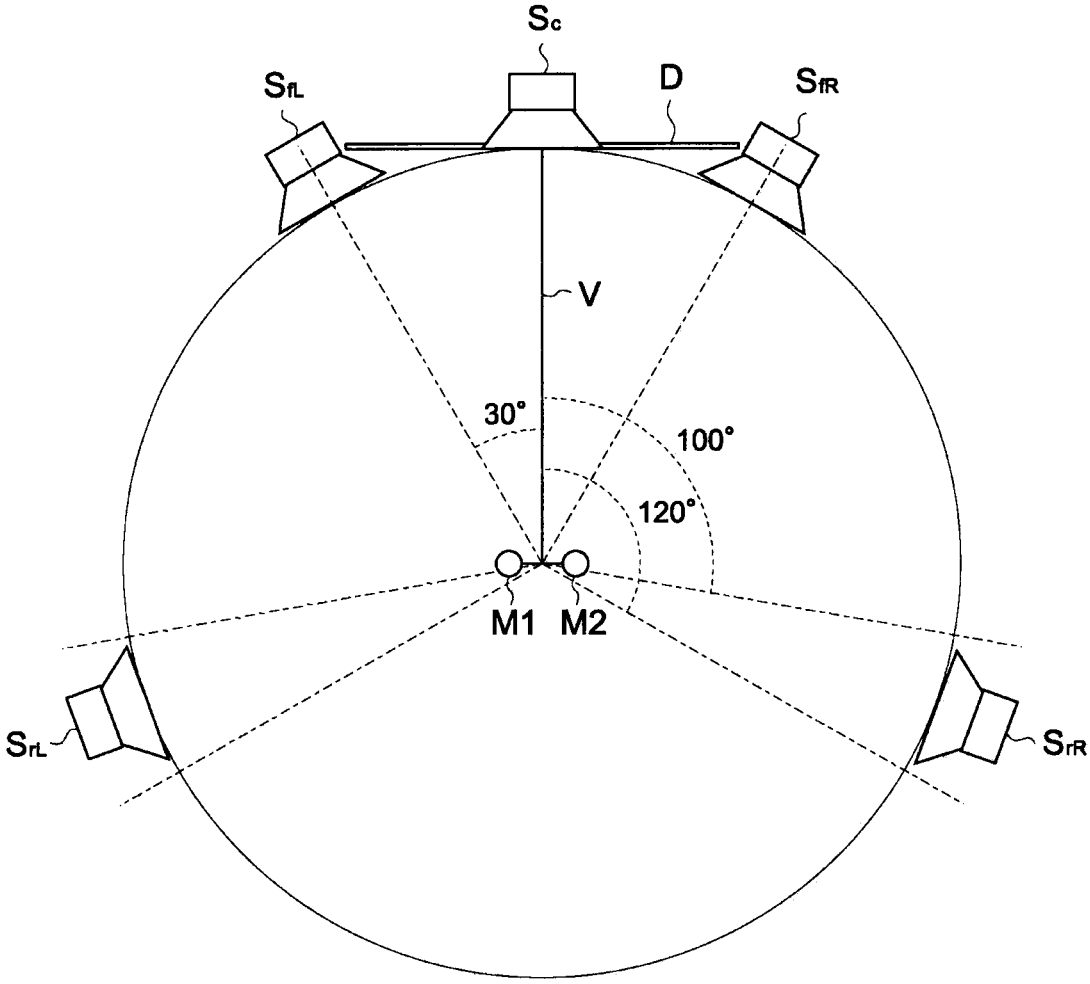
FIG. 4 is a plan view showing an ideal arrangement of a multi-channel speaker and a microphone.

The arrangement of the multi-channel speaker (center speaker $S_c$, front left speaker $S_{fL}$, front right speaker $S_{fR}$, rear left speaker $S_{rL}$, and rear right speaker $S_{rR}$) and the microphone will be described. FIG. 4 is a plan view showing an ideal arrangement of the multi-channel speaker and the microphone. The arrangement of the multi-channel speaker shown in FIG. 4 is in conformity with the ITU-R BS775-1 standard, but it may be in conformity with another standard. The multi-channel speaker is assumed to be arranged in a predetermined way as shown in FIG. 4. It should be noted that FIG. 4 shows a display D arranged at the position of the center speaker $S_c$.

In the arrangement of the multi-channel speaker shown in FIG. 4, the center position of the speakers arranged in a circumferential manner is prescribed as a listening position of a user. The first microphone M1 and the second microphone M2 are originally arranged so as to interpose the listening position therebetween and direct a perpendicular bisector V of a line connecting the first microphone M1 and the second microphone M2 to the center speaker $S_c$. The orientation of the perpendicular bisector V is referred to as an "orientation of microphone". However, in reality, there is a case where the orientation of the microphone may be deviated from the direction of the center speaker $S_c$ by the user. In this embodiment, the deviation of the perpendicular bisector V is taken into consideration (added or subtracted) to perform correction processing on an audio signal.

[Acoustic Adjustment Parameter]

An acoustic adjustment parameter will now be described. The acoustic adjustment parameter is constituted of three parameters of a "delay parameter", a "filter parameter", and a "signal distribution parameter". Those parameters are calculated in the analysis phase based on the above-mentioned arrangement of the multi-channel speaker, and used for correcting an audio signal in the reproduction phase. Specifically, the delay parameter is a parameter applied to the delay memories 34, the filter parameter is a parameter applied to the filters 33, and the signal distribution parameter is a parameter applied to the signal distribution blocks 32.

The delay parameter is a parameter used for correcting a distance between the listening position and each speaker. To obtain correct acoustic effects, as shown in FIG. 4, the distances between the respective speakers and the listening position are necessary to be equal to each other. Here, based on the distance between a speaker arranged farthest from the listening position and the listening position, delay processing is performed on an audio signal of the speaker arranged closest to the listening position, with the result that it is possible to make reaching times of audio to the listening position equal to each other and equalize the distances between the listening position and the respective speakers. The delay parameter is a parameter indicating this delay time.

The filter parameter is a parameter for adjusting a frequency characteristic and a gain of each speaker. Depending on the structure of the speaker or a reproduction environment such as reflection from a wall, the frequency characteristic and the gain of each speaker may differ. Here, an ideal frequency characteristic is prepared in advance and a difference between the frequency characteristic and a response signal output from each speaker is compensated, with the result that it is possible to equalize the frequency characteristics and gains of all speakers. The filter parameter is a filter coefficient for this compensation.

The signal distribution parameter is a parameter for correcting an installation angle of each speaker with respect to the listening position. As shown in FIG. 4, the installation angle of each speaker with respect to the listening position is predetermined. In the case where the installation angle of each speaker does not coincide with the determined angle, it may be impossible to obtain correct acoustic effects. In this case, by distributing an audio signal of a specific speaker to the speakers arranged on both sides of the specific speaker, it is possible to localize sound images at correct positions of the speakers. The signal distribution parameter is a parameter indicating a level of the distribution of the audio signal.

In this embodiment, in the case where the orientation of the microphone does not coincide with the direction of the center speaker $S_c$, an adjustment is made in accordance with an angle of the deviation between the microphone and the center speaker $S_c$ with use of the signal distribution parameter. Accordingly, it is possible to correct an installation angle of each speaker with the direction from the microphone to the center speaker $S_c$ as a reference.

[Operation of Audio Signal Processing Apparatus]

The operation of the audio signal processing apparatus 1 will be described. As described above, the audio signal processing apparatus 1 operates in the two phases of the analysis phase and the reproduction phase. When a user arranges the multi-channel speaker and inputs an operation to instruct the analysis phase, the audio signal processing apparatus 1 performs the operation of the analysis phase. In the analysis phase, an acoustic adjustment parameter corresponding to the arrangement of the multi-channel speaker is calculated and retained. When the user instructs reproduction, the audio signal processing apparatus 1 uses this acoustic adjustment parameter to perform correction processing on an audio signal, as an operation of the reproduction phase, and reproduces the resultant audio from the multi-channel speaker. After that, audio is reproduced using the above acoustic adjustment parameter unless the arrangement of the multi-channel speaker is changed. Upon change of the arrangement of the multi-channel speaker, an acoustic adjustment parameter is calculated again in the analysis phase in accordance with a new arrangement of the multi-channel speaker.

[Analysis Phase]

Figure 5:
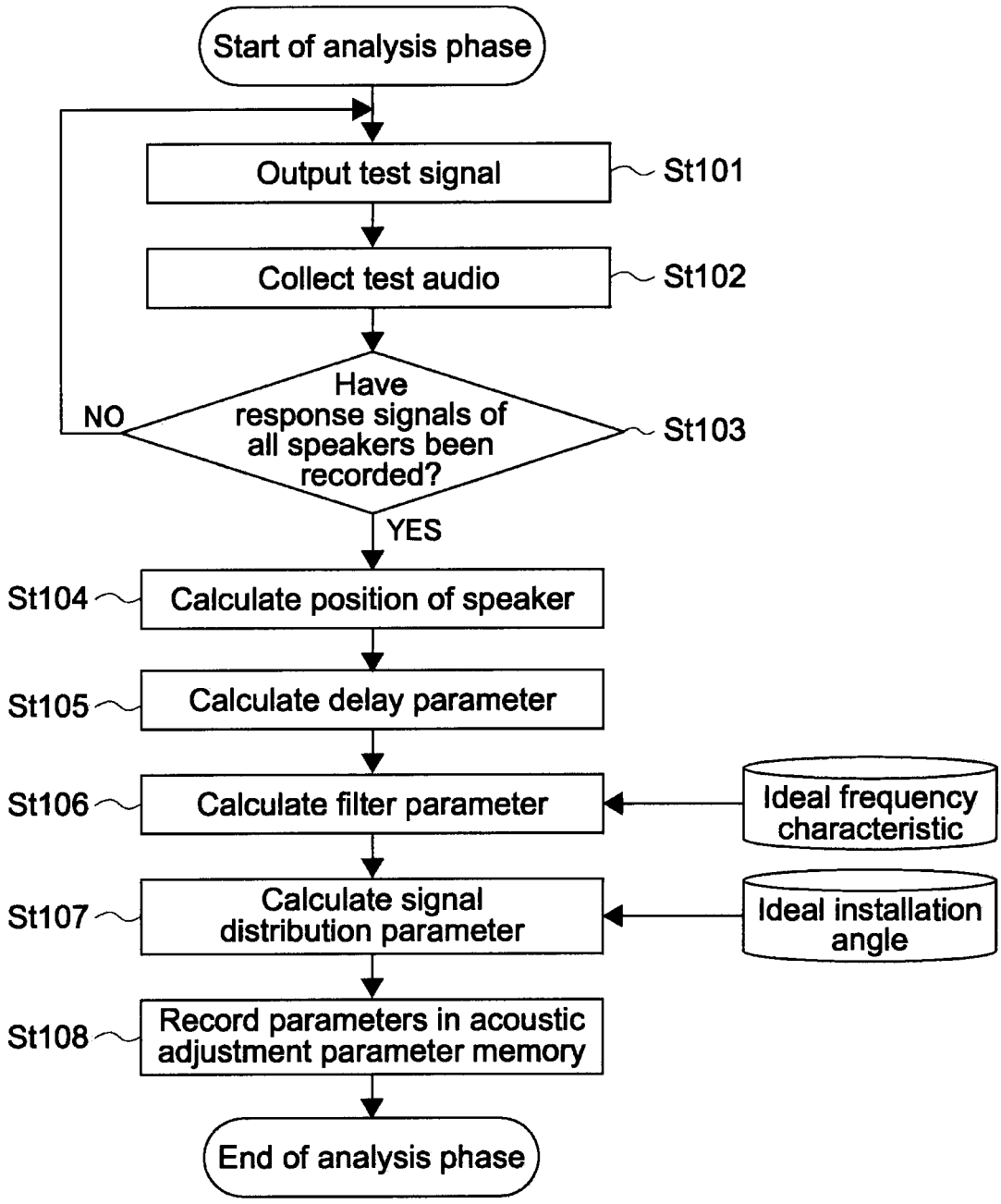
FIG. 5 is a flowchart showing an operation of the audio signal processing apparatus in the analysis phase according to the embodiment of the present disclosure.

The operation of the audio signal processing apparatus 1 in the analysis phase will be described. FIG. 5 is a flowchart showing an operation of the audio signal processing apparatus 1 in the analysis phase. Hereinafter, the steps (St) of the operation will be described in the order shown in the flowchart. It should be noted that the structure of the audio signal processing apparatus 1 in the analysis phase is as shown in FIG. 2.

Upon the start of the analysis phase, the audio signal processing apparatus 1 outputs a test signal from each speaker (St101). Specifically, the controller 21 reads a test signal from the test signal memory 22 via the internal data bus 25 and outputs the test signal to one speaker of the multi-channel speaker via the speaker signal line and the amplifier 5. The test signal may be an impulse signal. Test audio obtained by converting the test signal is output from the speaker to which the test signal is supplied.

Next, the audio signal processing apparatus 1 collects the test audio with use of the first microphone M1 and the second microphone M2 (St102). The audio collected by the first microphone M1 and the second microphone M2 are each converted into a signal (response signal) and stored in the response signal memory 24 via the amplifier 5, the microphone signal line, and the internal data bus 25.

The audio signal processing apparatus 1 performs the output of the test signal in Step 101 and collection of the test audio in Step 102 for all the speakers $S_c$, $S_{fL}$, $S_{fR}$, $S_{rL}$, and $S_{rR}$ of the multi-channel speaker (St103). In this manner, the response signals of all the speakers are stored in the response signal memory 24.

Figure 6:
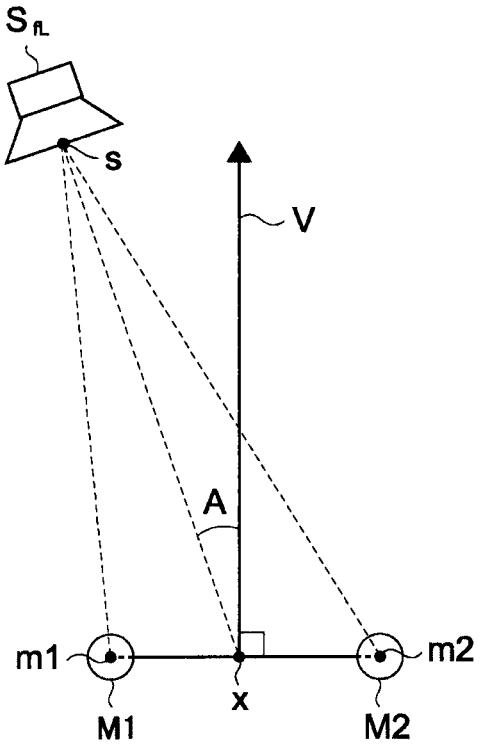
FIG. 6 is a schematic view showing how to calculate a position of a speaker by the audio signal processing apparatus according to the embodiment of the present disclosure.

Next, the audio signal processing apparatus 1 calculates a position of each speaker (distance and installation angle with respect to listening position) (St104). FIG. 6 is a schematic view showing how to calculate a position of a speaker by the audio signal processing apparatus 1. In FIG. 6, the front left speaker $S_{fL}$ is exemplified as one speaker of the multi-channel speaker, but the same holds true for the other speakers. As shown in FIG. 6, a position of the first microphone M1 is represented as a point m1, a position of the second microphone M2 is represented as a point m2, and a middle point between the point m1 and the point m2, that is, the listening position is represented as a point x. Further, a position of the front left speaker $S_{fL}$ is represented as a point s.

The controller 21 refers to the response signal memory 24 to obtain a distance (m1–s) based on a reaching time of the test audio collected in Step 102 from the speaker $S_{fL}$ to the first microphone M1. Further, the controller 21 similarly obtains a distance (m2–s) based on a reaching time of the test audio from the speaker $S_{fL}$ to the second microphone M2. Since a distance (m1–m2) between the first microphone M1 and the second microphone M2 is known, one triangle (m1, *m2,s*) is determined based on those distances. Further, a triangle (m1,*x,s*) is also determined based on the distance (m1–s), a distance (m1–x), and an angle (s–m1–x). Therefore, a distance (s–x) between the speaker $S_{fL}$ and the listening position x, and an angle A formed by the perpendicular bisector V and a straight line (s,x) are also determined. In other words, the distance (s–x) of the speaker $S_{fL}$ with respect to the listening position x and the angle A are calculated. For each of the speakers other than the speaker $S_{fL}$, similarly, based on a reaching time of test audio from each speaker to the microphone, a distance and an installation angle with respect to the listening position is calculated.

Referring back to FIG. 5, the audio signal processing apparatus 1 calculates a delay parameter (St105). The controller 21 specifies a speaker having the longest distance from the listening position among the distances of the speakers that are calculated in Step 104, and calculates a difference between the longest distance and a distance of another speaker from the listening position. The controller 21 calculates a time necessary for an acoustic wave to travel this difference distance, as a delay parameter.

Subsequently, the audio signal processing apparatus 1 calculates a filter parameter (St106). The controller 21 performs FFT (Fast Fourier transform) on a response signal of each speaker that is stored in the response signal memory 24 to obtain a frequency characteristic. Here, the response signal of each speaker can be a response signal measured by the first microphone M1 or the second microphone M2, or a response signal obtained by averaging response signals measured by both the first microphone M1 and the second microphone M2. Next, the controller 21 calculates a difference between the frequency characteristic of the response signal of each speaker and an ideal frequency characteristic determined in advance. The ideal frequency characteristic can be a flat frequency characteristic, a frequency characteristic of any speaker of the multi-channel speaker, or the like. The controller 21 obtains a gain and a filter coefficient (coefficient used for digital filter) from the difference between the frequency characteristic of the response signal of each speaker and the ideal frequency characteristic to set a filter parameter.

Figure 7:
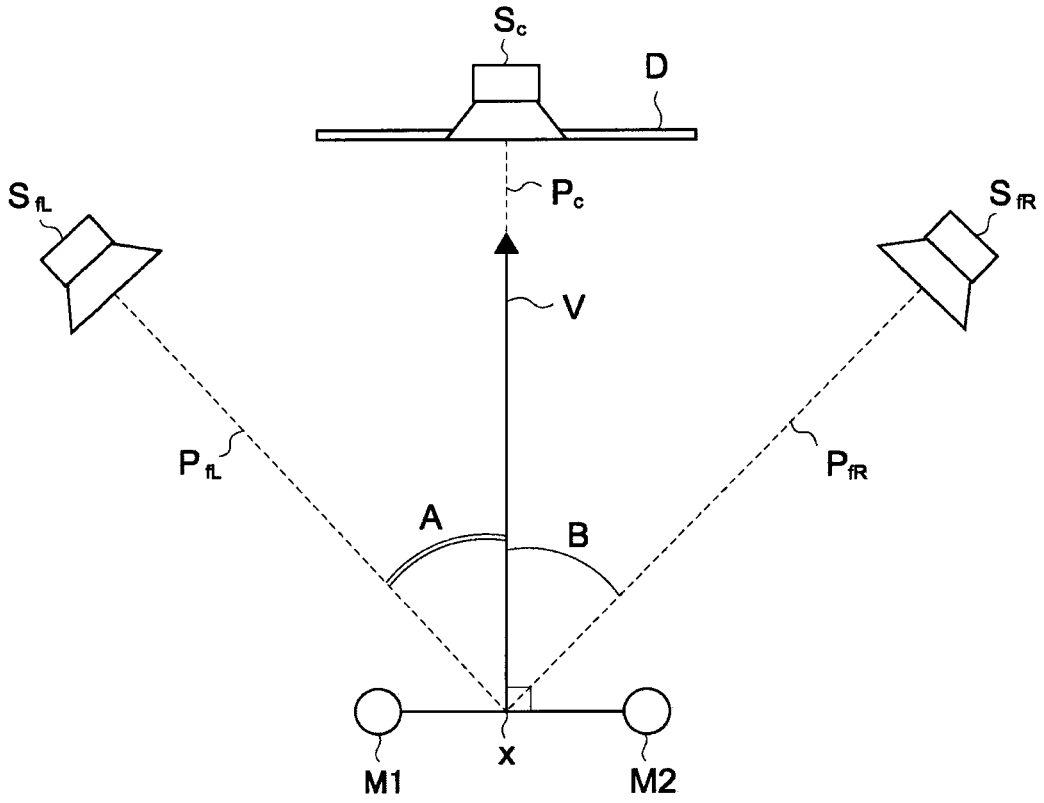
FIG. 7 is a conceptual view showing the position of each speaker with respect to the microphone according to the embodiment of the present disclosure.
Figure 8:
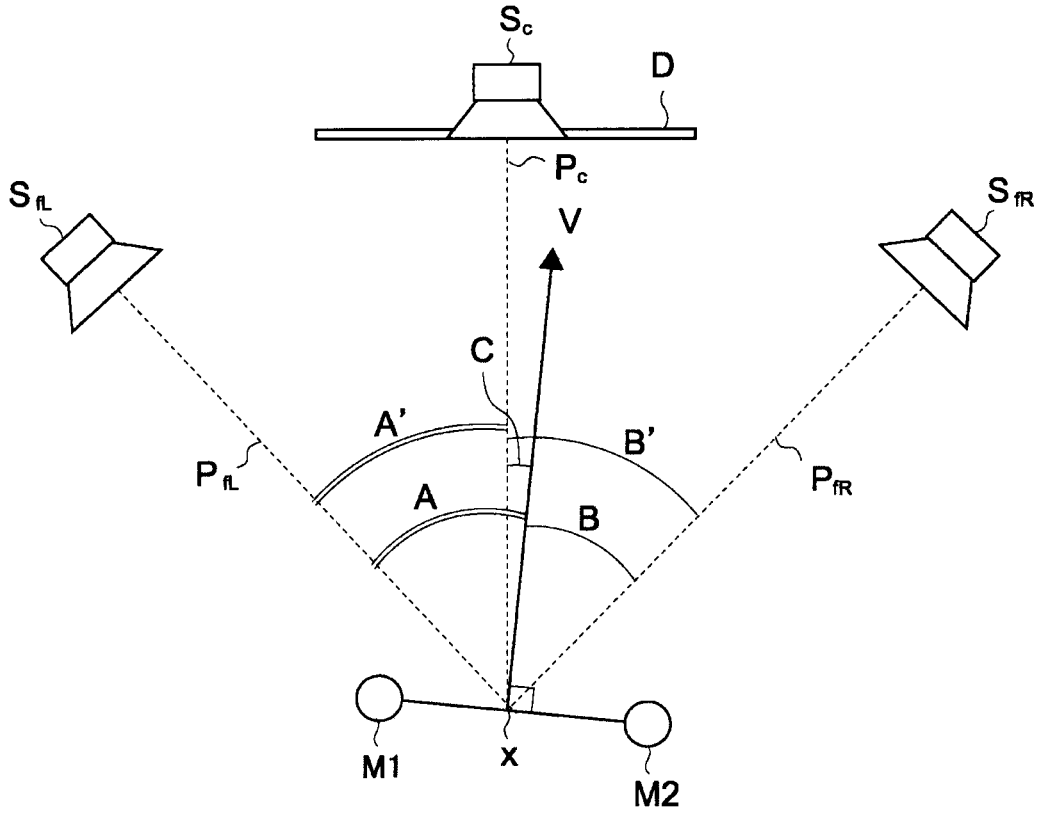
FIG. 8 is a conceptual view showing the position of each speaker with respect to the microphone according to the embodiment of the present disclosure.

Subsequently, the audio signal processing apparatus 1 calculates a signal distribution parameter (St107). FIG. 7 and FIG. 8 are conceptual views showing the position of each speaker with respect to the microphone. It should be noted that in FIG. 7 and FIG. 8, the illustration of the rear left speaker $S_{rL}$ and the rear right speaker $S_{rR}$ is omitted. FIG. 7 shows a state where a user arranges the microphone correctly and the orientation of the microphone coincides with the direction of the center speaker $S_c$. FIG. 8 shows a state where the microphone is not correctly arranged and the orientation of the microphone is different from the direction of the center speaker Sc. In FIG. 7 and FIG. 8, the direction of the front left speaker $S_{fL}$ from the microphone is represented as a direction $P_{fL}$, the direction of the front right speaker $S_{fR}$ from the microphone is represented as a direction $P_{fR}$, and the direction of the center speaker $S_c$ from the microphone is represented as a direction $P_c$.

As shown in FIG. 7 and FIG. 8, in Step 104, an angle of each speaker with respect to the orientation of the microphone (perpendicular bisector V) is calculated. FIG. 7 and FIG. 8 each show an angle formed by the front left speaker $S_{fL}$ and the microphone (angle A described above), an angle B formed by the front right speaker $S_{fR}$ and the microphone, and an angle C formed by the center speaker $S_c$ and the microphone. In FIG. 7, the angle C is 0°. As described above, the angle A, the angle B, and the angle C are each an installation angle of a speaker with the orientation of the microphone as a reference, the installation angle being calculated from the reaching time of test audio.

Based on those angles, the controller 21 calculates an installation angle of each speaker (excluding center speaker $S_c$) with the direction of the center speaker $S_c$ from the microphone as a reference. As shown in FIG. 8, in the case where the direction of the center speaker $S_c$ from the microphone is on the front left speaker $S_{fL}$ side with respect to the perpendicular bisector V, an installation angle A' of the front left speaker $S_{fL}$ with the direction of the center speaker $S_c$ from the microphone as a reference can be an angle (A'=A−C). Further, an installation angle B' of the front right speaker $S_{fR}$ with the direction of the center speaker $S_c$ as a reference can be an angle (B'=B+C). Unlike FIG. 8, in the case where the direction of the center speaker $S_c$ from the microphone is on the front right speaker $S_{fR}$ side with respect to the perpendicular bisector V, an installation angle A' of the front left speaker $S_{fL}$ with the direction of the center speaker $S_c$ as a reference can be an angle (A'=A+C). Further, an installation angle B' of the front right speaker $S_{fR}$ with the direction of the center speaker $S_c$ as a reference can be an angle (B'=B−C).

In this manner, based on the installation angles of the respective speakers with the orientation of the microphone as a reference, installation angles of the respective speakers with the direction of the center speaker $S_c$ from the microphone as a reference can be obtained. Further, although the front left speaker $S_{fL}$ and the front right speaker $S_{fR}$ have been described with reference to FIG. 7 and FIG. 8, installation angles of the rear left speaker $S_{rL}$ and the rear right speaker $S_{rR}$ can also be obtained in the same manner with the direction of the center speaker $S_c$ as a reference.

Figure 9:
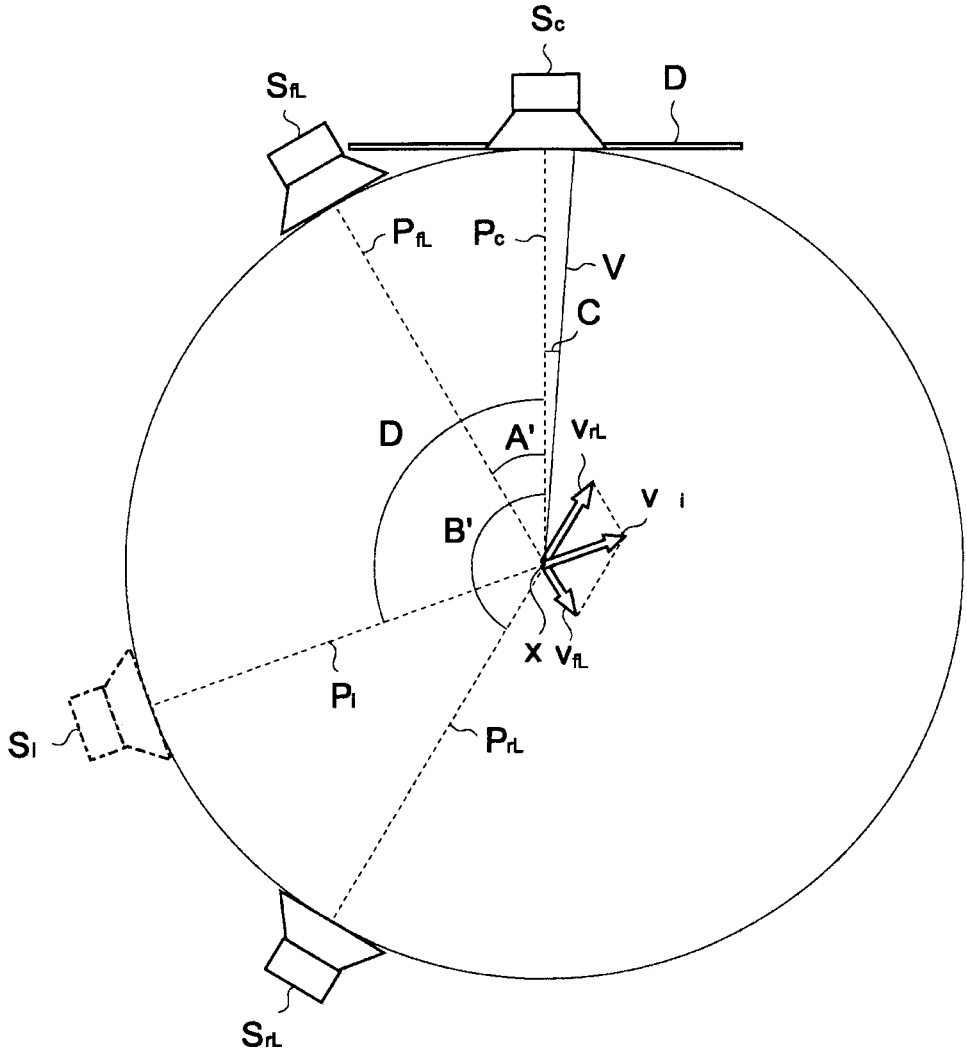
FIG. 9 is a conceptual view for describing a method of calculating a distribution parameter according to the embodiment of the present disclosure.

Based on the installation angles of the respective speakers thus calculated with the direction of the center speaker $S_c$ from the microphone as a reference, the controller 21 calculates a distribution parameter. FIG. 9 is a conceptual view for describing a method of calculating a distribution parameter. In FIG. 9, assuming that the rear left speaker $S_{rL}$ is arranged at an installation angle different from that determined by the above standard, the installation angle of the rear left speaker $S_{rL}$ that is determined by the standard is represented as an angle D. Here, in the installation angle of a speaker $S_i$ determined by the standard (ideal installation angle), the direction of the center speaker $S_c$ from the microphone is set as a reference, so the direction $P_c$ of the center speaker $S_c$ can be set as a reference as in the case of the front left speaker $S_{fL}$ and the rear left speaker $S_{rL}$.

As shown in FIG. 9, a vector $v_{fL}$ along a direction $P_{fL}$ of the front left speaker $S_{fL}$ and a vector $v_{rL}$ along a direction $P_{rL}$ of the rear left speaker $S_{rL}$ are set. In this case, a combined vector of those vectors is set as a vector $v_i$ along a direction $P_i$ of the speaker $S_i$. The magnitude of the vector $v_{fL}$ and that of the vector $v_{rL}$ are distribution parameters on a signal supplied to the rear left speaker $S_{rL}$.

Figure 10:
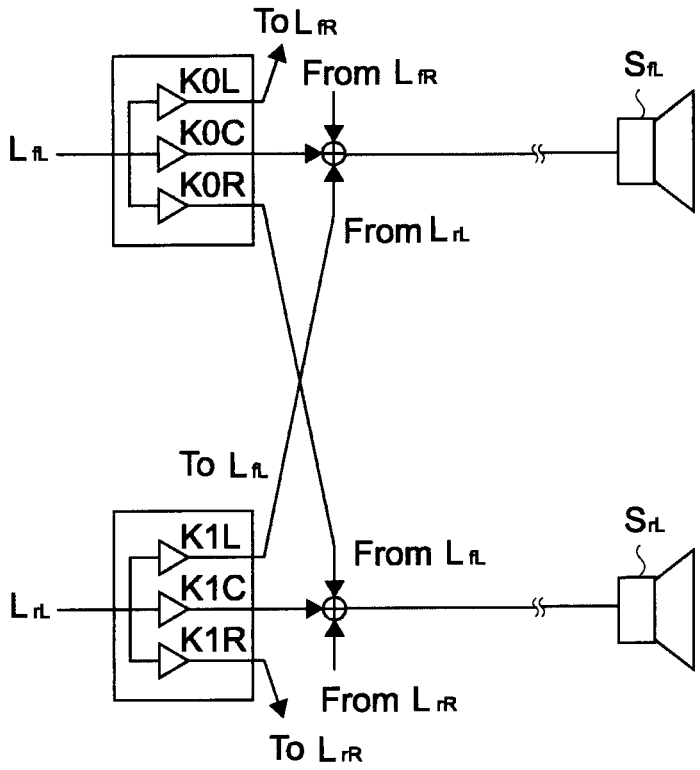
FIG. 10 is a schematic view showing signal distribution blocks connected to a front left speaker and a rear left speaker according to the embodiment of the present disclosure.

FIG. 10 is a schematic view showing the signal distribution blocks 32 connected to the front left speaker $S_{fL}$ and the rear left speaker $S_{rL}$. As shown in FIG. 10, a distribution multiplier K1C of the signal distribution block 32 of a rear left channel is set to have a magnitude of the vector $v_{rL}$, and a distribution multiplier K1L is set to have a magnitude of the vector $v_{fL}$, with the result that it is possible to localize a sound image at the position of the speaker $S_i$ in the reproduction phase. The controller 21 also calculates a distribution parameter for a signal supplied to another speaker, similarly to the signal supplied to the rear left speaker $S_{rL}$.

Referring back to FIG. 5, the controller 21 records the delay parameter, the filter parameter, and the signal distribution parameter calculated as described above in the acoustic adjustment parameter memory 23 (St108). As described above, the analysis phase is completed.

[Reproduction Phase]

Upon input of an instruction made by a user after the completion of the analysis phase, the audio signal processing apparatus 1 starts reproduction of audio as a reproduction phase. Hereinafter, description will be given using the block diagram showing the structure of the audio signal processing apparatus 1 in the reproduction phase shown in FIG. 3.

The controller 21 refers to the acoustic adjustment parameter memory 23 and reads the parameters of a signal distribution parameter, a filter parameter, and a delay parameter. The controller 21 applies the signal distribution parameter to each signal distribution block 32, the filter parameter to each filter 33, and a delay parameter to each delay memory 34.

When the reproduction of audio is instructed, an audio signal is supplied from the sound source N to the decoder 4. In the decoder 4, audio data is decoded and an audio signal for each channel is output to each of the speaker signal lines $L_c$, $L_{fL}$, $L_{fR}$, $L_{rL}$, and $L_{rR}$. An audio signal of a center channel is subjected to correction processing in the filter 33 and the delay memory 34, and output as audio from the center speaker $S_c$ via the amplifier 5. Audio signals of the other channels excluding the center channel are subjected to the correction processing in the signal distribution blocks 32, the filters 33, and the delay memories 34 and output as audio from the respective speakers via the amplifiers 5.

As described above, the signal distribution parameter, the filter parameter, and the delay parameter are calculated by the measurement using the microphone in the analysis phase, and the audio signal processing apparatus 1 can perform correction processing corresponding to the arrangement of the speakers on the audio signals. Particularly, the audio signal processing apparatus 1 sets, as a reference, not the orientation of the microphone but the direction of the center speaker $S_c$ from the microphone in the calculation of a signal distribution parameter. Accordingly, even when the orientation of the microphone is deviated from the direction of the center speaker $S_c$, it is possible to provide acoustic effects appropriate to the arrangement of the multi-channel speaker in conformity with the standard.

The present disclosure is not limited to the embodiment described above, and can variously be changed without departing from the gist of the present disclosure.

In the embodiment described above, the multi-channel speaker has five channels, but it is not limited thereto. The present disclosure is also applicable to a multi-channel speaker having another number of channels such as 5.1 channels or 7.1 channels.

The present disclosure contains subject matter related to that disclosed in Japanese Priority Patent Application JP 2010-130316 filed in the Japan Patent Office on Jun. 7, 2010, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An audio signal processing apparatus, comprising:

a test signal supply unit configured to supply a test signal to each of speakers of a multi-channel speaker including a center speaker and other speakers;

a speaker angle calculation unit configured to calculate an installation angle of each of the speakers of the multi-channel speaker with an orientation of a microphone as a reference, based on test audio output from each of the speakers of the multi-channel speaker by the test signals and collected by the microphone arranged at a listening position;

a speaker angle determination unit configured to determine an installation angle of each of the speakers of the multi-channel speaker with a direction of the center speaker from the microphone as a reference, based on the installation angle of the center speaker with the orientation of the microphone as a reference and the installation angles of the other speakers with the orientation of the microphone as a reference; and a signal processing unit configured to perform correction processing on an audio signal based on the installation angles of the speakers of the multi-channel speaker with the direction of the center speaker from the microphone as a reference, the installation angles being determined by the speaker angle determination unit.

2. The audio signal processing apparatus according to claim 1, wherein the signal processing unit distributes the audio signal supplied to one of the speakers of the multi-channel speaker to speakers adjacent to the speaker such that a sound image is localized at a specific installation angle with the direction of the center speaker from the microphone as a reference.

3. The audio signal processing apparatus according to claim 2, wherein the signal processing unit delays the audio signal such that a reaching time of the test audio to the microphone becomes equal between the speakers of the multi-channel speaker.

4. The audio signal processing apparatus according to claim 2, wherein the signal processing unit performs filter processing on the audio signal such that a frequency characteristic of the test audio becomes equal between the speakers of the multi-channel speaker.

5. An audio signal processing method, comprising:

supplying a test signal to each of speakers of a multi-channel speaker including a center speaker and other speakers;

calculating an installation angle of each of the speakers of the multi-channel speaker with an orientation of a microphone as a reference, based on test audio output from each of the speakers of the multi-channel speaker by the test signals and collected by the microphone arranged at a listening position;

determining an installation angle of each of the speakers of the multi-channel speaker with a direction of the center speaker from the microphone as a reference, based on the installation angle of the center speaker with the orientation of the microphone as a reference and the installation angles of the other speakers with the orientation of the microphone as a reference; and performing correction processing on an audio signal based on the installation angles of the speakers of the multi-channel speaker with the direction of the center speaker from the microphone as a reference, the installation angles being determined by a speaker angle determination unit.

* * * * *